US005160458A

United States Patent [19]

Yap

[11] Patent Number: 5,160,458

[45] Date of Patent: Nov. 3, 1992

[54] GAS INJECTION APPARATUS AND METHOD

[75] Inventor: Loo T. Yap, Princeton, N.J.

[73] Assignee: The BOC Group, Inc., New Providence, N.J.

[21] Appl. No.: 735,417

[22] Filed: Jul. 25, 1991

[51] Int. Cl.[5] ..... B01F 3/04

[52] U.S. Cl. ..... 261/76; 261/DIG. 75

[58] Field of Search ..... 261/DIG. 75, 76

[56] References Cited

U.S. PATENT DOCUMENTS

| | | | |
|---|---|---|---|
| 543,411 | 7/1895 | Taylor | 261/DIG. 75 |
| 2,762,202 | 9/1956 | Ponsar | 261/DIG. 75 |
| 3,446,488 | 5/1969 | Mail et al. | 261/DIG. 75 |
| 3,655,343 | 4/1972 | Galeano | 261/DIG. 75 |
| 3,826,742 | 7/1974 | Kirk et al. | 261/DIG. 75 |
| 3,928,199 | 12/1975 | Kirk et al. | 261/DIG. 75 |
| 4,138,330 | 2/1979 | Garrett | 261/DIG. 75 |
| 4,162,971 | 7/1979 | Zlokamik et al. | 261/DIG. 75 |
| 4,562,014 | 12/1985 | Johnson | 261/DIG. 75 |
| 4,834,343 | 5/1989 | Boyes | 261/DIG. 75 |
| 4,907,305 | 3/1990 | Teramachi et al. | 261/DIG. 75 |

FOREIGN PATENT DOCUMENTS

| | | | |
|---|---|---|---|
| 1039702 | 8/1966 | United Kingdom | 261/DIG. 75 |

*Primary Examiner*—Tim Miles

*Attorney, Agent, or Firm*—David M. Rosenblum; Larry R. Cassett

[57] ABSTRACT

The present invention provides a gas injection apparatus for dissolving a gas in a flowing liquid. The apparatus comprises a conduit having a passageway through which flowing liquid flows. An injection pipe in communication with the passageway is provided for injecting gas into the flowing liquid so that a plurality of undissolved gas bubbles are produced within the flowing liquid. Preferably, the passageway has a pair of opposed centrally located side pocket regions for dividing the flowing liquid into a main flow region flowing in the predominant direction of flow of the liquid and two circulating side flow region situated along side the main flow region and within which the gas dissolves. The gas dissolved in the side flow regions produces a concentration gradient driving the gas from the side flow regions into the main flow region for discharge out of an outlet of the conduit.

7 Claims, 2 Drawing Sheets

GAS INJECTION APPARATUS AND METHOD

BACKGROUND OF THE INVENTION

The present invention relates to a gas injection apparatus and method for injecting a gas into a flowing liquid with the objective of dissolving the gas into the liquid.

There are many prior art systems and devices that require the injection of a gas into a liquid, for instance, low viscosity fermentation systems, waste-water treatment systems, etc. By way of an example, in prior art waste-water treatment plants, airborne oxygen is dissolved in an atomized spray of waste water produced by a sprinkler system. Such oxygen addition, referred to in the art as aeration, destroys water-borne bacteria and reduces hydrocarbon contaminants.

Since air only contains about 21% oxygen, a more recent development in waste-water treatment is to inject pure oxygen directly into the waste water. At normal ambient temperatures, however, the dissolution rate of oxygen in water is rather slow; and thus, the prior art has provided injection devices and methods to enhance the oxygen dissolution rate in water. For example, in U.S. Pat. No. 3,928,199, oxygen is injected into a stream of flowing waste water which upon reaching a fall section, undergoes a precipitous drop to a lower level at which the falling water generates a highly turbulent zone. The turbulent zone of falling water produces a high rate of oxygen transfer into the waste water. As may be appreciated, U.S. Pat. No. 3,928,199 requires construction of a series of rises and drops for the falling water.

U.S. Pat. No. 4,834,343 discloses a device that is more compact than the arrangement set forth in the aforementioned '199 patent for injecting a gas into a liquid, such as oxygen in water. In U.S. Pat. No. 4,834,343, the dissolution of the gas into the liquid occurs in a vertical column. Liquid enters at the top of the column in two streams, one vertical and the other horizontal. The vertical stream produces a vertical downflow within the column. The gas is bubbled into the horizontal stream which also acts to impart rotational movement to the downflow. The gas bubbles are moved in a cyclonic motion and dissolve within the liquid before discharge at the bottom of the column. As may be appreciated a branching arrangement of pipes, fittings etc. and a specially fabricated column are incorporated in the device disclosed in the '343 patent.

As will be discussed, the present invention provides an apparatus and method for injecting a gas into a liquid that is more compact and less complicated than the apparatus and methods of the prior art.

SUMMARY OF THE INVENTION

The present invention provides a gas injection apparatus for dissolving a gas in a flowing liquid. The apparatus comprises a conduit and injection means. The conduit has at least one inlet for receiving the flowing liquid, at least one outlet for discharging the flowing liquid, and a passageway communicating between at least one inlet and at least one outlet. The flowing liquid flows through the passageway in a flow direction taken from the at least one inlet to the at least one outlet. Injection means is provided in communication with the passageway for injecting the gas into the liquid so that a plurality of undissolved gas bubbles are produced within the flowing liquid. The passageway has separation means for separating the flowing liquid into at least one main flow portion flowing in the flow direction and at least one circulating side flow region flowing along side the main flow region and within which the gas bubbles circulate and dissolve. The dissolution of the gas in the at least one circulating side flow region produces a concentration gradient driving the gas from the at least one circulating side flow region to the at least one main flow region.

The present invention also provides a method of dissolving a gas into a flowing liquid. In accordance with such method, gas is injected into the flowing liquid so that a plurality of undissolved gas bubbles are produced within the flowing liquid. The flowing liquid is separated into at least one main flow region flowing in a direction of predominant flow of the flowing liquid and at least one circulating side flow region flowing along side the main flow region and within which the gas bubbles circulate and dissolve to produce a concentration gradient driving the gas, once dissolved, from the at least one circulating side flow region to the main flow region.

BRIEF DESCRIPTION OF THE DRAWING

While the specification concludes with claims particularly pointing at the subject matter that applicant regards as his invention, it is believed that the invention will be better understood from the following description taken in conjunction with the accompanying drawings in which:

DETAILED DESCRIPTION

Figure 1:
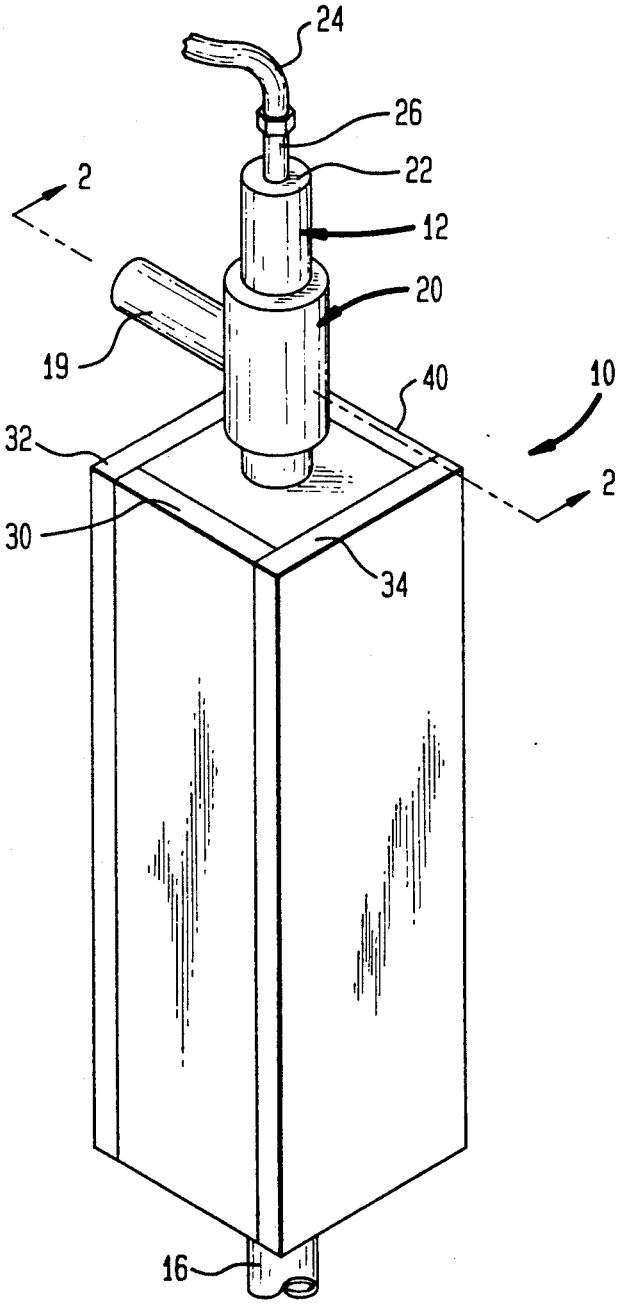
FIG. 1 is a prospective view of a gas injection apparatus in accordance with the present invention.
Figure 2:
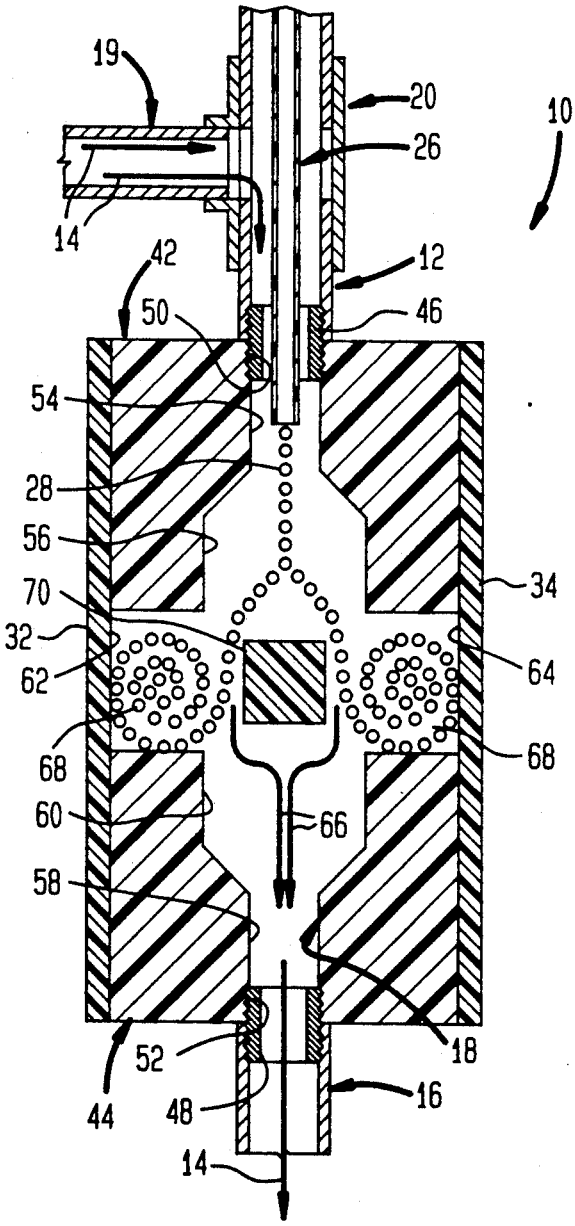
FIG. 2 is a fragmentary cross-sectional view of the apparatus illustrated in FIG. 1 taken along line 2—2.

With reference to the Figures, a preferred embodiment of a gas-injection apparatus 10 in accordance with the present invention is illustrated. Gas-injection apparatus 10 is particularly adapted for injecting oxygen into waste water produced in a waste-water treatment plant. However, it should be pointed out that gas-injection apparatus 10 could be used to inject any gas of limited solubility, such as oxygen, nitrogen, argon, carbon dioxide and ozone into any flowing inorganic solvent having material compatibility with the gas to be injected.

Apparatus 10 comprises a conduit having an inlet formed by an inlet pipe 12 for receiving a flowing liquid designated by arrowheads 14, an outlet formed by an outlet pipe 16 for discharging flowing liquid 14 and a passageway 18 communicating between inlet and outlet pipes 12 and 16 and through which flowing liquid 14 flows in a flow direction taken from inlet pipe 12 to outlet pipe 16. Inlet pipe 12 is connected to a process pipe 19 by a tee 20. In a waste water treatment plant, process pipe 19 would receive pumped waste water from the bottom of a shallow holding tank. In such a waste water treatment plant, outlet pipe 16 would reenter the waste water treatment tank to circulate oxygenated water back into the tank. Inlet pipe 12 has a closed top end 22 at which a gas injection line 24 is connected to a gas injection tube 26. Gas injection tube 26 extends into passageway 18 for injecting the gas into flowing liquid 14 so that a plurality of undissolved gas bubbles 28 are produced within flowing liquid 14.

Passageway 18 is formed by a rectangular box-like structure having a set of four rectangular plates 30, 32, 34, and 40 joined together edge to edge to receive a pair of opposed inserts 42 and 44. Rectangular plates 30-40 and inserts 42 and 44 can be formed of plexiglass in case of a waste water treatment application for apparatus 10.

Inlet pipe 12 and outlet pipe 16 are connected to inserts 42 and 44 by a pair of opposed threaded couplings 46 and 48 threaded within a pair of opposed common threaded cylindrical sections 50 and 52 of passageway 18. Cylindrical sections 50 and 52 smoothly transition to a pair of opposed primary and secondary sections (designated by reference numerals 54 and 56 for insert 42; and reference numerals 58 and 60 for insert 44). The primary and secondary sections of passageway 18 are of square transverse cross-section. Inserts 42 and 44 are spaced apart from one another to produce a pair of opposed side pocket regions 62 and 64 which are again of rectangular transverse cross-section.

Flowing liquid 14 flows into side pocket regions 62 and 64 from primary and secondary sections 54 and 56 of insert 42. As illustrated, the total cross sectional area of passageway 18 is widest at side pocket regions 62 and 64 and then narrows from secondary section 56 to primary section 54. At a point slightly before side pocket regions 62 and 64, the flow of flowing liquid 14 divides into a main flow region, designated by arrowheads 66 and two opposed circulating side flow regions designated by reference numerals 68. The reason for this is that side pocket regions 62 and 64 present a sudden enlargement in flow area that the flow cannot follow causing a separation of the flow resulting in circulating fluid in side pocket region 62 and 64. The sudden enlargement in flow area which here produces circulating flow is commonly referred to in the art as a "rearward facing step".

Bubbles 28 circulate and dissolve within circulating side flow regions 68. Bubbles 28, thus travel along a spiraling flow path and for an enhanced residence time along the flow path. As a result, more gas in a given time period is able to dissolve in the liquid than by the use of conventional dissolution techniques. The increased dissolution of the gas within side flow regions 68 produces a concentration gradient between the side and main flow regions to drive the dissolved gas back into the main flow region. Thus, side flow regions 68 are continually transferring dissolved gas to allow for continued dissolution of gas therein.

Under certain flow conditions, it is possible that undissolved gas bubbles will remain in the main flow region 66 without ever being swept into side flow regions 68. In order to prevent such an occurrence, a stagnation block 70 may be provided in passageway 18 between side pockets 62 and 64.

It should be pointed out that apparatus 10, although a preferred embodiment, is only one of many possible embodiments of the invention described herein. For instance, it is possible to construct an embodiment of the present invention that has only one of the side pocket regions 62 and 64 so that only one side flow portion 68 is produced. It is also to be noted that while due to the square cross-section of the flow path, the flow of flowing liquid 14 is two dimensional, it is possible to construct apparatus 10 such that primary and secondary sections 54 and 56 of passageway 8 have a circular transverse cross-section, and the enlargement between primary and secondary sections 54 and 56, produced by side pocket regions 62 and 64 of the preferred embodiment, is of cylindrical configuration. In such case, the circulating side flow regions would comprise one circulating flow region surrounding the main flow region. Moreover, there are other possible designs of a passageway to produce more than two regions of circulating flow situated along side a main flow region. In such case, a passageway could be provided with the necessary inlets and outlets and rearward facing steps to produce several regions of circulation. In addition to the foregoing, a possible embodiment of apparatus 10 could employ gas injection directly into side pocket regions 62 and 64 rather than an upstream point of injection from which undissolved gas bubbles 28 are swept into side pocket regions 62 and 64.

As an example, apparatus 10 can be designed to inject oxygen at a rate of about 0.5 liters per minute into water flowing at about 15.14 liters per minute. In such example, both oxygen and water have a pressure in a range of between about 1.76 $kg/cm^2$ and about 2.11 $kg/cm^2$. Additionally, inserts 42 and 44 are each about 10.16 cm. long by about 10.16 cm. wide by about 5.08 cm. in thickness and are spaced about 7.62 cm apart to form side pocket regions 62 and 64. Each of the primary sections 54 and 56 of passageway 18 are about 2.54 cm. long by about 1.27 cm. wide; and each of the secondary sections 68 and 60 of passageway 18 are about 1.905 cm. wide by about 4.76 cm. long. Stagnation block 70 is approximately 2.54 cm$\times$2.22 cm.$\times$5.08 cm. and is set back about 2.54 cm. in front of insert 44.

Although preferred embodiments have been shown and described in detail, it will be understood and appreciated by those skilled in the art that numerous omissions, changes and additions may be made without departing from the spirit and scope of the invention.

I claim:

1. A gas injection apparatus for dissolving a gas into a flowing liquid, said apparatus comprising:

a conduit having, at least one inlet for receiving the flowing liquid, at least one outlet for discharging the flowing liquid, and a passageway communicating between the at least one inlet and the at least one outlet and through which the flowing liquid flows in a flow direction taken from the inlet to the outlet; and injection means in communication with the passageway for injecting the gas into the flowing liquid so that a plurality of undissolved gas bubbles are produced within the flowing liquid;

the passageway having at least one rearward facing step for separating the flowing liquid into at least one main flow region flowing in the flow direction and at least one circulating side flow region located along side the at least one main flow region and within which the undissolved gas bubbles circulate and dissolve to produce a concentration gradient driving the gas, once dissolved, from the at least one circulating side flow region to the at least one main flow region.

2. The gas injection apparatus of claim 1, wherein the passageway includes an inlet section, an outlet section spaced from and in a coaxial relationship with the inlet section, and a central section connecting the inlet and the outlet sections and having a pair of opposed side pockets to form the separating means by providing two of the at least one rearward facing steps.

3. The gas injection apparatus of claim 2, further including a stagnation block situated in the central section to prevent the undissolved gas bubbles from being swept back into the main flow region from the two at least one circulating side flow regions.

4. The gas injection apparatus of claim 2, wherein the injection means comprises a tube adapted to be connected to a source of the gas to be injected into the liquid, the tube located within the inlet section of the passageway in a coaxial relationship therewith and up stream of the central section so that the gas bubbles are swept into the two of the at least one circulating side flow regions after the flowing liquid divides.

5. A method of dissolving a gas into a flowing liquid comprising:

injecting the gas into the flowing liquid so that a plurality of undissolved gas bubbles are produced within the flowing liquid; and separating the flowing liquid by at least one rearward facing step into at least one main flow region flowing in a predominant direction of flow of the flowing liquid and at least one circulating side flow region located along side the at least one main flow region and within which the undissolved gas bubbles circulate and dissolve to produce a concentration gradient driving the gas, once dissolved, into the main flow region.

6. The method of claim 5, wherein the flowing liquid is separated into two of the at least one circulating side flow regions separated by the at least one main flow region.

7. The method of claim 6, wherein the gas is injected up stream of the separation so that the undissolved gas bubbles are swept into the two at least one circulating side flow regions.

* * * * *